US005829275A

United States Patent [19]

Babuin et al.

[11] Patent Number: 5,829,275

[45] Date of Patent: Nov. 3, 1998

[54] CLOTHES WASHING MACHINE WITH LINT FILTER MONITOR

[75] Inventors: Piero Babuin, Pordenone; Silvano Cimetta, Treviso, both of Italy

[73] Assignee: Electrolux Zanussi Elettrodomestici S.p.A., Pordenone, Italy

[21] Appl. No.: 834,257

[22] Filed: Apr. 15, 1997

[30] Foreign Application Priority Data

May 14, 1996 [IT] Italy ..... PN96A0027

[51] Int. Cl.[6] ..... D06F 33/02; D06F 39/08; D06F 39/10

[52] U.S. Cl. ..... 68/12.13; 68/18 F; 68/208

[58] Field of Search ..... 68/12.13, 18 F, 68/208

[56] References Cited

U.S. PATENT DOCUMENTS

| | | | |
|---|---|---|---|
| 2,287,628 | 6/1942 | McMahan | 68/18 F X |
| 2,621,505 | 12/1952 | Smith | 68/12.13 |
| 3,282,072 | 11/1966 | Neumann | 68/12.13 X |
| 4,580,421 | 4/1986 | Babuin et al. | 68/18 F X |

FOREIGN PATENT DOCUMENTS

| | | | |
|---|---|---|---|
| 0245870 | 11/1987 | European Pat. Off. | 68/18 F |
| 152985 | 5/1992 | Japan | 68/208 |
| 2058148 | 4/1981 | United Kingdom | 68/208 |

*Primary Examiner*—Philip R. Coe
*Attorney, Agent, or Firm*—Pearne, Gordon, McCoy & Granger LLP

[57] ABSTRACT

A monitoring arrangement for the filter of a washing machine is disclosed wherein the user is warned of the clogged filter when an actual clogging condition occurs. Control elements that are normally used in washing machines, such as an analog pressure switch (13) and an electronic control circuit (14), are utilized. The control parameter for detecting clogging is the variation of the water pressure before and after the priming of the drain pump (12) or the recirculator pump (17) of the machine.

5 Claims, 4 Drawing Sheets

CLOTHES WASHING MACHINE WITH LINT FILTER MONITOR

BACKGROUND OF THE INVENTION

The present invention relates in general to household-type clothes washing machines, and more particularly, to clothes washing machines incorporating one or more filters in the water circulation circuit of the machine to separate lint, dirt particles, and other foreign matter from the washing water.

A filter is usually provided upstream of the water drain or discharge pump of the machine to protect the discharge pump and to prevent foreign matter from being discharged from the machine. In clothes washing machines in which the washing water is recirculated by a separate recirculation pump, a filter may also be provided in the washing water recirculation circuit of the machine, upstream of the recirculation pump.

In both of these cases, the respective filter ensures correct operation of the machine. However, for each respective filter to perform in an effective manner, the filter must be cleaned periodically. In practice, it often occurs that the user initially cleans the filter or filters at rather frequent intervals, but, since the user finds the filter or filters to be sufficiently clean most of the time, tends to check the filter or filters at increasingly less frequent intervals and eventually fails to remember about it completely, thereby putting the good performance capability of the washing machine in jeopardy.

Various types of filter monitor arrangements have been proposed for automatically informing the user of a clogged condition of the filter, so as to alert the user to the need for filter cleaning.

European patent publication EP-A-28067 teaches to use a timer to monitor a pressure switch which is referenced to the minimum water level in the wash tub of the machine. When the time needed by the water in the tub to drain to aid minimum level during water discharge exceeds a predetermined value, such a condition indicates that the filter is clogged, and an indicator light therefore illuminates to alert the user to the need for filter cleaning.

European patent publication EP-A-245870 teaches to use a sensor connected in series with a resistor that heats up to higher than usual temperature values when the filter is clogged, thereby causing a clogged filter indicator to be switched on to indicate the need for filter cleaning.

A number of other solutions exist, such as, for instance, the use of photodiodes to detect the passage of light through the filter (see European patent publication EP-A-443361).

However, all such prior art solutions require the addition of component parts that add to the machine in terms of cost and complexity, as well as perhaps lower reliability.

It is therefore an object of the present invention to provide a continuous monitoring arrangement for the water filter or filters in a clothes washing machine that will alert the user to the need to clean a clogged filter.

Such a monitoring arrangement should preferably use an existing analogue pressure switch of the machine and the existing electronic control circuit of the machine.

SUMMARY OF THE INVENTION

In accordance with the present invention, a pressure switch associated respectively with the drain pump or recirculator pump provides a control circuit of a clothes washing machine with a signal indicative of the water pressure prevailing in a water circulator circuit of the machine. The control circuit compares a stabilized value of the water pressure when the respective drain pump or recirculator pump is deactivated, with a value of water pressure immediately after actuation of the associated drain pump or recirculator pump. A signal resulting from the comparison is used to indicate the condition of the associated filter, i.e., clogged or unclogged.

BRIEF DESCRIPTION OF THE DRAWINGS

A fuller understanding of the invention may be had by referring to the following description and claims taken in conjunction with the accompanying drawings, wherein:

DESCRIPTION OF THE PREFERRED EMBODIMENTS

Figure 1:
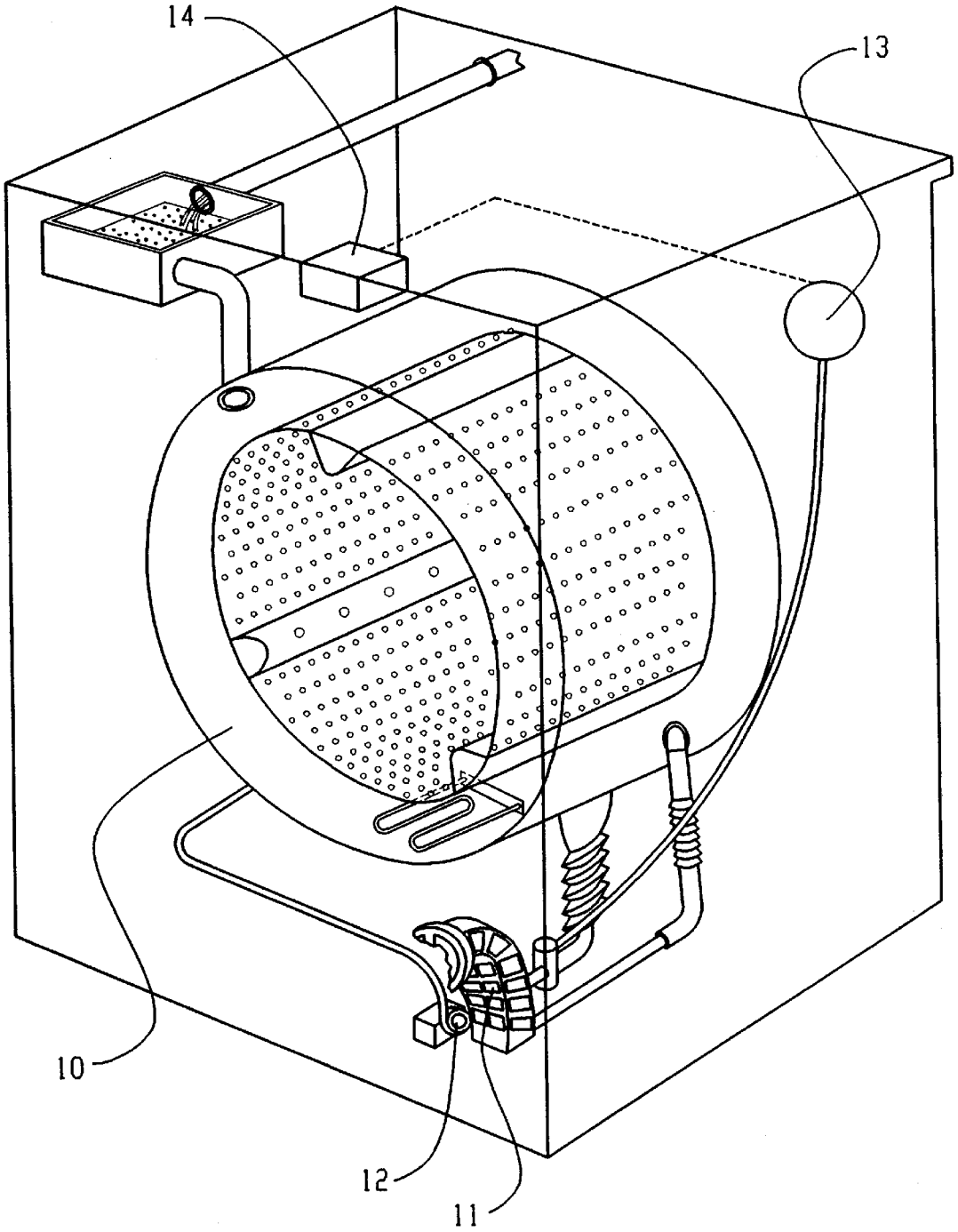
FIG. 1 is a simplified schematic view of a first embodiment of a clothes washing machine with a filter monitoring arrangement according to the present invention.

With reference to FIG. 1, a first embodiment of the present invention is illustrated. A clothes washing machine of a traditional type comprises a wash tub 10, a filter 11 for the wash water, a drain pump 12 for the wash water, a pressure switch 13, preferably of the analog type, for controlling the level of the water in the wash tub, and a control circuit 14, preferably of the electronic type, for governing the operational functions of the machine.

The component parts of the machine which are utilized in the implementation of the present invention are the analog-type pressure switch 13 and the drain pump 12. The parameter that is used to detect the clogged filter condition and, therefore, to alert the user of the need for the filter to be cleaned, is the pressure variation in the pressure switch 13 between an instant in which the drain pump is at a standstill, i.e., not operating, and a subsequent instant in which the drain pump is primed and attempting to pump water.

Figure 2:
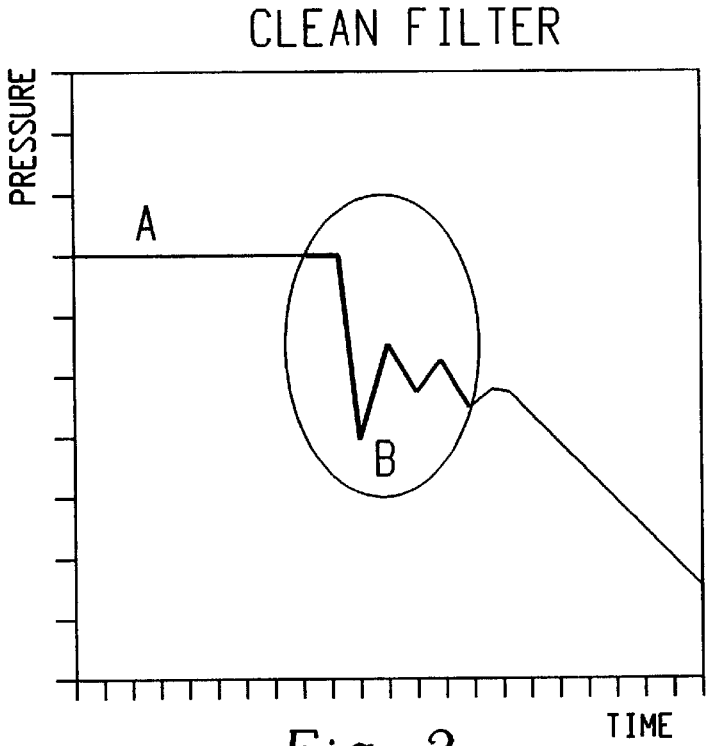
FIGS. 2 and 3 are diagrammatical views of the pressure curves for a clean filter and a clogged filter, respectively, in a first embodiment of FIG. 1.

As illustrated in FIG. 2, when the pump 12 is at a standstill, the pressure (A) in the water circuit of the machine is static and stabilized. When the pump 12 starts priming and then pumping, the pressure drops sharply (B) and, after a short period during which it oscillates, keeps decreasing until the water discharge operation is concluded. The illustrated curve occurs when the filter 11 is normally clean.

In the case of a clogged filter 11 (FIG. 3), on the contrary, the pressure (B') drops only slightly when the drain pump starts priming and then pumping, while the subsequent oscillations may even give rise to pressure peaks that are higher than the static pressure prevailing when the pump 12 is not operating. Such characteristics, as graphically illustrated, have been verified experimentally and are indicative of water flow through the filter 11 and the resistance thereto as a result of filter 11 clogging.

The pressure reading, or sensing, and resultant comparison, is preferably made in the last water discharge phase of a complete washing cycle, although it will be appreciated that it may be arranged to occur in any water discharge phase carried out by the machine.

After the wash tub 10 has been filled with water for the last rinse operation, the drum holding the washload is driven to rotate at slow speed for a period of approximately 4 minutes. This is followed by a pause (e.g., of 20 seconds), during which the pressure in the water circuit of the machine is allowed to stabilize at the level (A) indicated in FIG. 2. The drain pump 12 then starts to prime and pump and, as usual, the machine is emptied before the final spin-extraction phase is started.

The reading of the pressure in the water circuit of the machine is carried out for a very short initial time (for instance, 7/10ths of a second) after the priming, i.e., actuation, of the drain pump 12 and the variation in the values of water pressure delivered by the analog pressure switch 13 is analyzed with the following logic sequence: a) reading of the pressure after 20 seconds of pause; b) reading of the maximum pressure drop at the priming of the drain pump 12.

If the pressure after the priming of the drain pump 12 has a lower value than that of the stabilized pressure in the 20 seconds preceding the discharge operation, then the filter 11 may be considered as being clean (FIG. 2).

Figure 3:
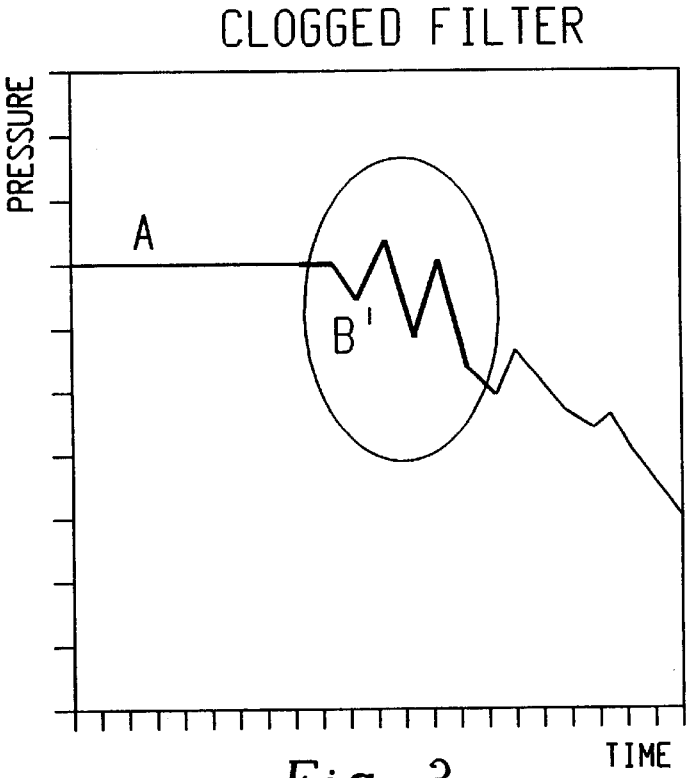

If the pressure after the priming of the drain pump 12 has a value which is equal or even higher than that of the stabilized pressure in the 20 seconds preceding the discharge operation, then the filter 11 may be considered as being clogged (FIG. 3). In this case, the electronic control circuit 14 of the machine would therefore deliver a signal, which may be of any known type, i.e., acoustical, optical, combined acoustical and optical, etc., to correspondingly alert the user.

Figure 4:
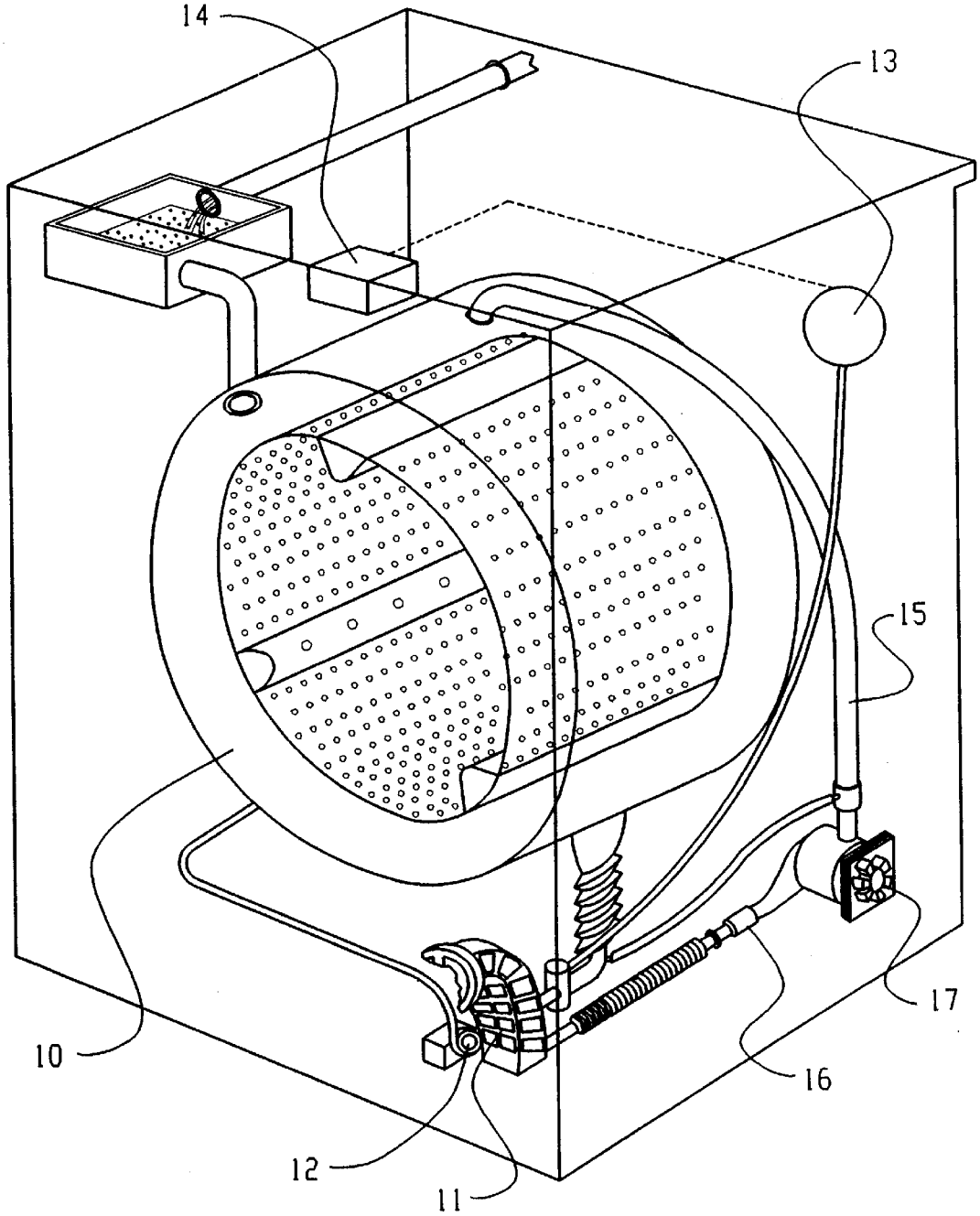
FIG. 4 is a simplified schematic view of a second embodiment of a clothes washing machine with a recirculation pump for the wash water, including a filter monitoring arrangement according to the present invention.

With reference to FIG. 4, a second embodiment of the present invention will now be described with reference to a recirculating-type clothes washing machine comprising, in addition to the earlier noted components, a circuit 15 for recirculating the water in the wash tub 10 of the machine during a wash cycle, another filter 16, and a recirculation pump 17 included in said water recirculating circuit.

In this particular case, the reading of the pressure variation is made through the recirculation pump 17, since it is the effectiveness of the washing process that is monitored over the effectiveness of the water discharge operation, as discussed above with regard to FIGS. 1–3. In fact, the filter 16 included in the water recirculating circuit 15 has a filtering surface which is reduced with respect to the filter 11 installed in the drain system of the machine, wherein the filter 16 is more quickly prone to clogging.

The manner in which the readings and the related comparisons are made here is substantially similar to the one described above.

After the tub 10 has been filled with water for the last rinse operation, the drum holding the washload is driven to rotate at slow speed for a period of approximately 4 minutes. Then, the machine is stopped (e.g., for a period of 20 seconds). After that, the recirculation pump 17 is started again and allowed to operate for approximately 10 seconds, while the variation in the pressure is observed for an initial time of approximately 1 second for due comparison with the value of the static pressure prevailing in the preceding pause period.

Figure 5:
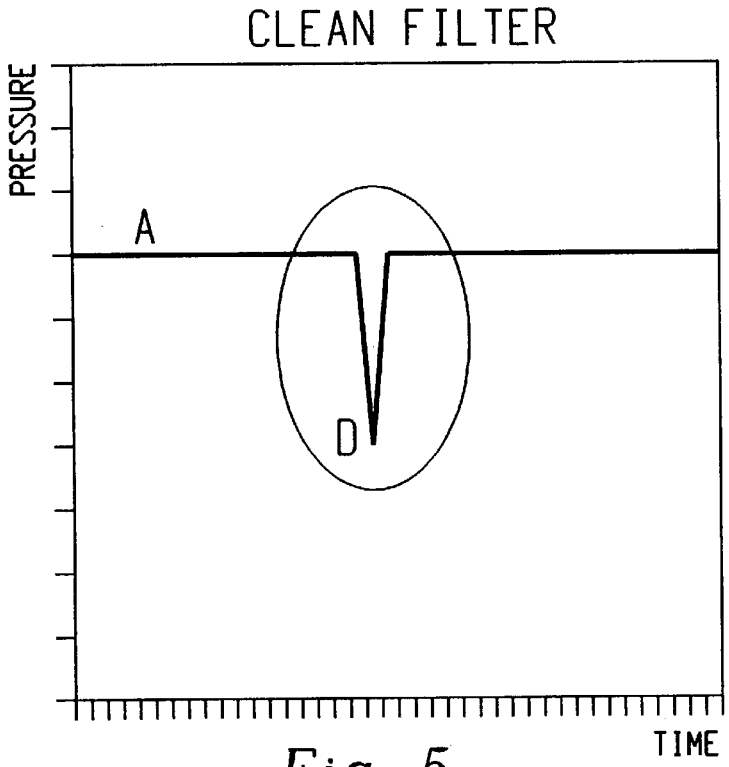
FIGS. 5 and 6 are diagrammatical views of the pressure curves for a clean filter and a clogged filter, respectively, in a second embodiment of FIG. 3.

If the pressure drop (D) at the priming or actuation of the recirculation pump (see FIG. 5) has a value which is equal to or even higher by 10% than that of the stabilized pressure (A) prevailing in the pause period, then the filter 16 may be considered as being clean.

Figure 6:
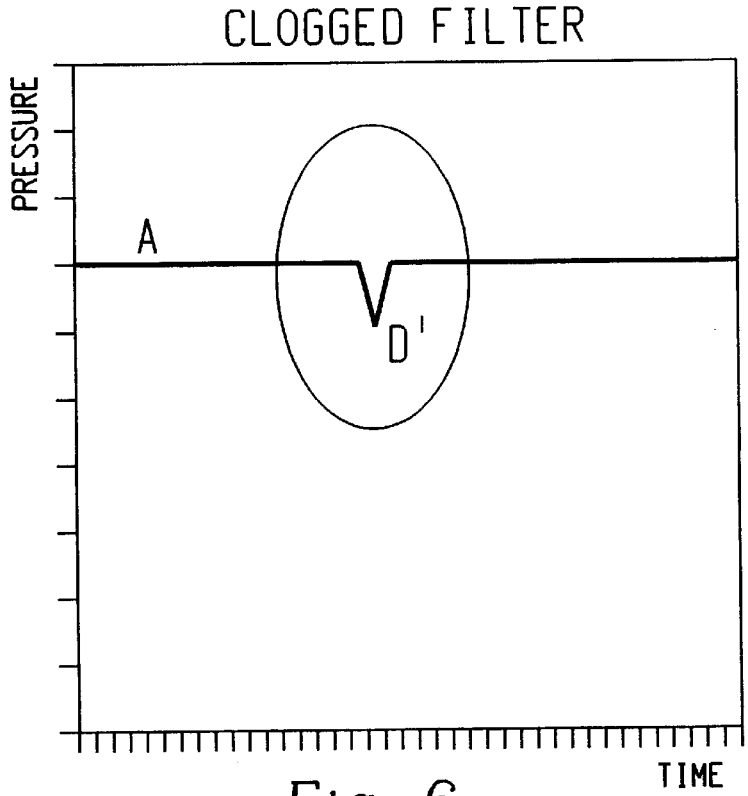

If the pressure drop (D') at the priming of the recirculation pump 17 (see FIG. 6) has a value which is lower by 10% than that of the stabilized pressure (A) prevailing in the preceding pause period, then the filter 16 may be considered as being clogged, so that, as this has been described in connection with the first embodiment, an appropriate signal would be delivered to alert the user of the need to clean the filter 16.

It can be readily noticed, therefore, that the invention enables the user to be automatically and timely informed of the filter 11, 16 being clogged and requiring cleaning without any need arising for additional component parts to be used in the machine to achieve such an aim, but making on the contrary simple use, albeit in a rational and innovative manner, of some of the component parts which normally exist in the same machine.

Various further improvements and variants are of course possible, i.e., may be implemented without departing from the scope of the present invention. For example, by making use of the existing analog pressure switch 13 and the existing control circuit 14 of the clothes washing machine, it is possible for the user to be given also an indication of a possible obstruction of the drain pump 12, as well as the recirculation pump 17. In fact, by applying the same afore described concept, it is, for instance, possible for the drain pump 12 to be stopped for approximately 20 seconds in any one of the operating phases of the machine and the stabilized pressure detected after such a pause to be compared with the pressure detected after approximately 15 seconds from the moment in which the drain pump 12 is restarted. Should the pressure detected after the drain pump 12 has been restarted be lower than the pressure detected after the pause, the drain pump 12 may be considered to be operating correctly. Should, on the contrary, the pressure detected after the drain pump 12 has been restarted be equal to or even higher than the pressure detected after the pause, the drain pump 12 has to be considered as obstructed.

It should be evident that this disclosure is by way of example, and the various changes may be made by adding, modifying or eliminating details without departing from the fair scope of the teaching contained in this disclosure. The invention is, therefore, not limited to particular details of this disclosure except to the extent that the following claims are necessarily so limited.

What is claimed is:

1. In a clothes washing machine including a wash tub (10), a drain pump (12) for discharging washing water, a switch (13) for controlling the level of the washing water in the tub, a filter (11) for separating foreign matter from the washing water, and an electronic circuit (14) for controlling the operation of the machine, the improvement wherein said switch (13) is adapted to supply said electronic circuit (14) with a continuous analog indication of the pressure prevailing in a water circuit of the machine, said electronic circuit (14) being adapted to compare a value of the stabilized water pressure (A), when the drain pump is at a standstill, with a value of a water pressure (B) immediately after a priming of the drain pump (12), in order to supply a signal which is indicative of the operating condition of the filter (11).

2. A clothes washing machine according to claim 1, wherein the machine has a plurality of discharge phases and said electronic circuit (14) is adapted to carry out said comparison between said pressure values (A, B) in any water discharge phase of the machine.

3. A clothes washing machine according to claim 1, wherein the machine further includes a recirculating circuit (15) for recirculating the washing water in the wash tub, said recirculating circuit including a filter (16) and a recirculating pump (17), wherein the electronic circuit is adapted to make a comparison between the pressure value (A) when the recirculating pump (17) is at a standstill and a water pressure value (D) after a priming of the recirculating pump, in order to supply a signal which is indicative of the operating condition of the filter (16).

4. A clothes washing machine according to claim 3, wherein the machine has a plurality of discharge phases and said electronic circuit (14) is adapted to carry out said comparison between said pressure values (A, D) in any water discharge phase of the machine.

5. A clothes washing machine including a wash tub (10), a switch (13) for controlling the level of washing water in the tub (10), an electronic circuit (14) for controlling the operation of the machine, a recirculating circuit (15) for recirculating the washing water in the wash tub (10), the recirculating circuit (15) including a filter (16) and a recirculating pump (17), wherein the switch (13) is adapted to supply the electronic circuit (14) with a continuous analog indication of the pressure prevailing in a water circuit of the machine, the electronic circuit (14) being adapted to compare a value of stabilized water pressure (A) and a water pressure value (D) after a priming of the recirculation pump (17), in order to supply a signal which is indicative of the operating condition of the filter (16).

* * * * *